US010184254B2

(12) United States Patent
Piché et al.

(10) Patent No.: US 10,184,254 B2
(45) Date of Patent: Jan. 22, 2019

(54) COVERING PANEL WITH SIMULATED BUILDING ELEMENTS

(71) Applicant: NOVIK INC., St-Augustin-de-Desmaures (CA)

(72) Inventors: Mathieu Piché, Québec (CA); Martin Forget, Québec (CA)

(73) Assignee: Derby Building Products Inc., St-Augustin-de-Desmaures, Quebec (CA)

( * ) Notice: Subject to any disclaimer, the term of this patent is extended or adjusted under 35 U.S.C. 154(b) by 0 days.

(21) Appl. No.: 15/167,179

(22) Filed: May 27, 2016

(65) Prior Publication Data

US 2017/0022719 A1 Jan. 26, 2017

Related U.S. Application Data

(60) Provisional application No. 62/166,855, filed on May 27, 2015.

(51) Int. Cl.
*E04D 1/26* (2006.01)
*E04F 13/08* (2006.01)
*E04F 13/18* (2006.01)

(52) U.S. Cl.
CPC ..... *E04F 13/0894* (2013.01); *E04F 13/0846* (2013.01); *E04F 13/185* (2013.01)

(58) Field of Classification Search
CPC . E04F 13/0864; E04F 13/185; E04F 21/1855; E04F 13/083; E04F 13/0862; E04F 13/0871; E04F 13/147; E04F 2201/0123; E04F 2201/0511
See application file for complete search history.

(56) References Cited

U.S. PATENT DOCUMENTS 2,811,118 A * 10/1957 Ball ..... E04D 1/18 52/518
4,094,115 A * 6/1978 Naz ..... E04F 13/0864 52/51
5,076,037 A * 12/1991 Crick ..... E04D 1/265 52/520
5,537,792 A * 7/1996 Moliere ..... E04F 13/0864 52/521

(Continued)

*Primary Examiner* — Gisele D Ford

(74) *Attorney, Agent, or Firm* — Eversheds Sutherland (US) LLP

(57) ABSTRACT

A covering panel securable to a bearing substrate and having a fastener strip with a plurality of fastener apertures spaced apart along a longitudinal axis of the covering panel. The covering panel comprises a plurality of hammer stops extending forwardly from a section of the fastener strip including the fastener apertures. Each one of the hammer stops is associated to a corresponding one of the fastener apertures and comprises at least one elevated hammer head stop surface protruding from the fastener strip and elevated therefrom and a hammer head alignment guide abutable with a section of a hammer head to position the hammer head in a predetermined configuration with respect to the corresponding one of the fastener apertures. The at least one elevated hammer head stop surface is configured to abut with the hammer head at a distance from the section of the fastener strip including the fastener apertures.

19 Claims, 11 Drawing Sheets

(56) References Cited

U.S. PATENT DOCUMENTS

| | | | | |
|---|---|---|---|---|
| 6,336,303 | B1 * | 1/2002 | Vandeman | B44C 1/28 52/313 |
| 6,393,792 | B1 * | 5/2002 | Mowery | E04F 13/18 52/506.05 |
| 8,020,353 | B2 | 9/2011 | Gaudreau | |
| 8,209,938 | B2 * | 7/2012 | Gaudreau | B29C 45/03 52/311.1 |
| 9,464,442 | B1 * | 10/2016 | Olczyk | E04F 13/0862 |
| 2005/0262797 | A1 * | 12/2005 | Davis | E04F 13/0864 52/712 |
| 2008/0083186 | A1 * | 4/2008 | Gaudreau | E04D 1/265 52/520 |
| 2008/0155922 | A1 * | 7/2008 | Wolf | E04F 13/0862 52/386 |
| 2010/0088988 | A1 * | 4/2010 | Gaudreau | E04F 13/0864 52/309.1 |
| 2014/0174015 | A1 * | 6/2014 | Gaudreau | E04B 1/38 52/588.1 |

* cited by examiner

COVERING PANEL WITH SIMULATED BUILDING ELEMENTS

CROSS REFERENCE TO RELATED APPLICATION

This application claims the benefit under 35 U.S.C. § 119(e) of U.S. provisional patent application No. 62/166,855 which was filed on May 27, 2015. The entirety of the aforementioned application is herein incorporated by reference.

TECHNICAL FIELD

The present invention relates to the field of covering panels. More particularly, it relates to covering panels securable to a bearing substrate using mechanical fasteners and to a method of installation for same.

BACKGROUND

To facilitate installation of siding and roofing covering panels, polymer panels designed for such a use commonly include a plurality of fastener apertures each comprising an elongated slot defined in a section of each panel. In order to perform installation thereof, it is customary to drive a mechanical fastener, such as, for example and without being limitative, a nail or the like, through each slot and into a bearing substrate to which the panel is superposed, thus securing the panel thereto. The elongated slots can be configured to allow the panel to slide relative to the mechanical fastener extending through the slot and secured to the underlying bearing substrate, as the polymer material of the panel expands and contracts due to changing environmental temperatures. In order to favor movement between the panel and the mechanical fastener, the mechanical fastener should be positioned substantially in a middle of each elongated slot in order to permit the unfettered relative movement of the panel in either direction (i.e. in order to accommodate both contraction and expansion of the panel).

Unfortunately, hasty installation can lead to the misplacement of the mechanical fasteners inside the elongated slot, thereby leading to the mechanical fastener being located too close to either ends of the slots, rather than substantially in the middle thereof. When such misplacement of the mechanical fasteners occurs, relative movement of the panel in either direction with regards to the mechanical fastener can lead to abutment of the fastener with one of the slot ends, thereby resulting in unwanted buckling of the panel.

In addition to misplacement along the elongated slots, another common occurrence during installation of such panels is for fasteners to be driven too deeply into the substrate, such that the panel is effectively pinned against the bearing substrate and unable to move relative to the fastener in response to changes in the environmental temperature. Similarly to misplacement of the fastener within the slot, this alternative installation error can also lead to unwanted buckling of the panel. In some cases, the fastener can even be driven through the panel completely, for example when a pneumatic hammer is used to drive the fastener, thereby leading to no securement of the panel to the bearing substrate.

In order to alleviate some of the above-described issues, fastener centering-guides and hammer stops are known for limiting the depth to which a fastener can be driven into each elongated slot by a hammer (see for instance U.S. Pat. No. 8,020,353 granted to the Applicant). For example, one such centering-guides and hammer stop comprises a raised, rigid stop surfaces with the stop surfaces positioned about each elongated slot so as to confront the face of a hammer having a head diameter greater than the distance between the stop surfaces. The stop surfaces of such a hammer stop are elevated above each elongated slot of a distance sufficient to prevent the mechanical fastener from being driven into the slot to a depth at which the panel is prevented from moving relative to the mechanical fastener during expansion and contraction of the panel. The elongated slot can also include a visual indicator of the position along the slot where the mechanical fastener is to be inserted.

Known centering-guides and hammer stops however tend to suffer from several drawbacks. For example, known centering-guides and hammer stops are not adapted to be used in combination with pneumatic hammers. Indeed, such pneumatic hammers commonly have hammer head shapes which make it difficult to properly position the pneumatic hammer in order to insert the mechanical fastener in proper position along the elongated groove (substantially in the middle thereof) and/or at a proper height relative to the elongated groove (to ensure that the mechanical fastener discharged by the pneumatic hammer is not driven to deeply into the substrate or completely through the panel), when using panels provided with existing centering-guides and/or hammer stops. Hence, the hasty installation of a polymer panel with a pneumatic hammer can lead to the misplacement of fasteners too close to either ends of the elongated slots and/or too deep within the bearing substrate, thereby leading to unwanted buckling of the building product.

Another drawback associated with the installation of known polymer panels relates to their installation when employed in a vertical interlocking engagement with adjacent covering panels requiring an overlap of the marginal edge sections of the panels to cover and conceal the fasteners. The panels are typically planar but slanted when mounted to the bearing substrate, i.e. diagonally-extending with respect to the substrate. Thus, following installation, an upper marginal edge section abuts the bearing substrate while a lower marginal edge section is spaced apart therefrom. A relatively long section of the panel is spaced-apart from the bearing substrate when secured thereto. When pressure is momentarily applied thereon, the covering panels mounted to the bearing substrate offers some springback, i.e. they bend towards the bearing substrate when pressure is applied thereon and return to their original configuration when the pressure is removed. Such springback reduces the resemblance with natural building elements.

In view of the above, there is a need for an improved covering panel which, by virtue of its design and components, would be able to overcome or at least minimize some of the above-discussed prior art concerns.

BRIEF SUMMARY OF THE INVENTION

In accordance with a first general aspect, there is provided a covering panel securable to a substrate by fasteners driven by a hammer having a hammer head. The covering panel includes a front surface, a rear surface opposed to the front surface and facing the substrate when secured thereto, and a fastener strip. The fastener strip includes a plurality of fastener apertures disposed serially along a length of the covering panel, the fastener strip being juxtaposed to the substrate when the panel is secured therewithin. The covering panel further includes a plurality of hammer stops extending from the front surface coextensively with the plurality of fastener apertures. Each hammer stop includes at least one elevated hammer head stop surface protruding forwardly from the front surface and configured so as to confront the hammer head at a distance from the fastener strip, and a hammer head alignment guide configured so as to position the hammer head with respect to a respective one of the fastener apertures.

In accordance with another general aspect, there is provided a covering panel securable to a substrate. The covering panel comprises: an upper marginal region securable to the substrate; and a covering section extending downwardly from the upper marginal region. The covering section is arcuate in a manner such that when the upper marginal region is juxtaposed and secured to the substrate, the lower region of the covering section is spaced apart from the substrate.

In an embodiment, the covering section comprises a plurality of horizontal rows of simulated building elements, each one of the rows being arcuate with an upper region of each one of the rows being closer to the substrate than a corresponding lower region of each one of the rows. The lower regions of each one of the rows can be spaced-apart from the substrate when covering panel is secured to the substrate.

In accordance with another general aspect, there is provided a covering panel securable to a bearing substrate using fasteners driven by a hammer having a hammer head. The covering panel comprises a front surface and a rear surface opposed to the front surface and facing the bearing substrate when the covering panel is secured thereto. The covering panel also comprises a fastener strip comprising a plurality of fastener apertures spaced apart along a longitudinal axis of the covering panel. The fastener strip is juxtaposed to the bearing substrate when the covering panel is secured thereto. The covering panel also comprises a plurality of hammer stops extending forwardly from a section of the fastener strip including the fastener apertures. Each one of the hammer stops is associated to a corresponding one of the plurality of fastener apertures and comprises at least one elevated hammer head stop surface protruding from the section of the fastener strip including the fastener apertures and elevated therefrom and a hammer head alignment guide abutable with a section of the hammer head to position the hammer head in a predetermined configuration with respect to the corresponding one of the fastener apertures. The at least one elevated hammer head stop surface is configured to abut with the hammer head at a distance from the section of the fastener strip including the fastener apertures.

In an embodiment, the hammer head alignment guide defines a concave surface.

In an embodiment, the concave surface is curvilinear.

In an embodiment, wherein the hammer head alignment guide is positioned below the corresponding one of the fastener apertures and comprises a shelf surface positioning the hammer head with respect to the corresponding one of the fastener apertures by gravity.

In an embodiment, the at least one elevated hammer head stop surface comprises a first elevated hammer head stop surface extending below the corresponding one of the fastener apertures and a second elevated hammer head stop surface extending above the corresponding one of the fastener apertures.

In an embodiment, the first elevated hammer head stop surface and the second elevated hammer head stop surface are substantially evenly levelled.

In an embodiment, each one of the plurality of fastener apertures comprises a main aperture and elongated fastener slots extending longitudinally from the main aperture, the elongated fastener slots having a width smaller than the diameter of the main aperture.

In an embodiment, a lower portion of the hammer head alignment guide is substantially aligned with the main aperture along the longitudinal axis of the covering panel.

In an embodiment, the covering panel further comprises a lateral flange, at least one flange hammer stop extending forwardly from a section of the lateral flange. The lateral flange comprises at least one flange fastener aperture and is juxtaposed to the bearing substrate when the covering panel is secured therewith. Each one of the flange hammer stops is associated to a corresponding one of the at least one flange fastener aperture and comprises at least one elevated flange hammer head stop surface protruding from the section of the lateral flange and elevated therefrom and a flange hammer head alignment guide abutable with a section of the hammer head to position the hammer head in a predetermined configuration with respect to the corresponding one of the at least one flange fastener aperture. The at least one elevated flange hammer head stop surface is configured to abut with the hammer head at a distance from the section of the lateral flange including the at least one flange fastener aperture.

In an embodiment, the flange hammer head alignment guide defines a concave surface.

In an embodiment, the concave surface is curvilinear.

In an embodiment, the flange hammer head alignment guide is positioned below the corresponding one of the flange fastener apertures and comprises a shelf surface positioning the hammer head with respect to the corresponding one of the fastener apertures by gravity.

In an embodiment, the covering panel further comprises a lateral section opposed to the lateral flange along the longitudinal axis of the covering panel. The lateral flange comprises at least one lateral interconnection tab having a jaw extending forwardly of a section of the lateral flange and defining a lateral engagement slot and the lateral section has a hook extending rearwardly from a section thereof. The lateral interconnection tab and the hook are configured for the lateral engagement slot of the lateral interconnection tab of a first covering panel to slidingly receive a section of the hook of a second laterally adjacent covering panel therein through substantially horizontal displacement of at least one of the first covering panel and the second covering panel.

In an embodiment, one of the at least one flange elevated hammer head stop surfaces and the flange hammer head alignment guide of each flange hammer stop are defined in a front surface of the jaw of a corresponding one of the at least one lateral interconnection tab.

In accordance with another general aspect, there is further provided a covering panel securable to a bearing substrate. The covering panel comprises an upper marginal region securable to the bearing substrate and a covering section extending downwardly from the upper marginal region and having a lower end. The covering section is arcuate along a transverse axis of the covering panel and defines a concave curvature. The lower end of the covering section is spaced apart from the bearing substrate when the upper marginal region is juxtaposed and secured to the bearing substrate.

In an embodiment, a deflection of the covering section with regards to the bearing substrate is between about 1/16 of an inch and about 1 inch.

In an embodiment, the covering section comprises a plurality of horizontal rows of simulated building elements, each one of the horizontal rows having an upper end and a lower end, each one of the horizontal rows being arcuate and defining a concave curvature. The upper end of each one of the plurality of horizontal rows of simulated building elements is closer to the bearing substrate than the lower end thereof.

In an embodiment, the combination of the curvatures of each one of the rows of simulated building elements of the covering section defines a covering section having a downwardly and outwardly extending curvature relative to the bearing substrate onto which the covering panel is secured.

In an embodiment, the lower end of each one of the rows of simulated building elements of the covering section is spaced-apart from the bearing substrate when the covering panel is secured to the bearing substrate.

In an embodiment, a deflection of each one of the rows of simulated building elements of the covering section with regards to the bearing substrate is between about 1/16 of an inch and about 1 inch.

In an embodiment, the covering panel comprises a lateral flange comprising at least one lateral interconnection tab having a jaw extending forwardly of a section of the lateral flange and defining a lateral engagement slot and a lateral section opposed to the lateral flange along the longitudinal axis of the covering panel comprising a hook extending rearwardly from a section thereof. The lateral interconnection tab and the hook are configured for the lateral engagement slot of the lateral interconnection tab of a first covering panel to slidingly receive a section the hook of a second laterally adjacent covering panel therein through substantially horizontal displacement of at least one of the first covering panel and the second covering panel.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

Figure 1:
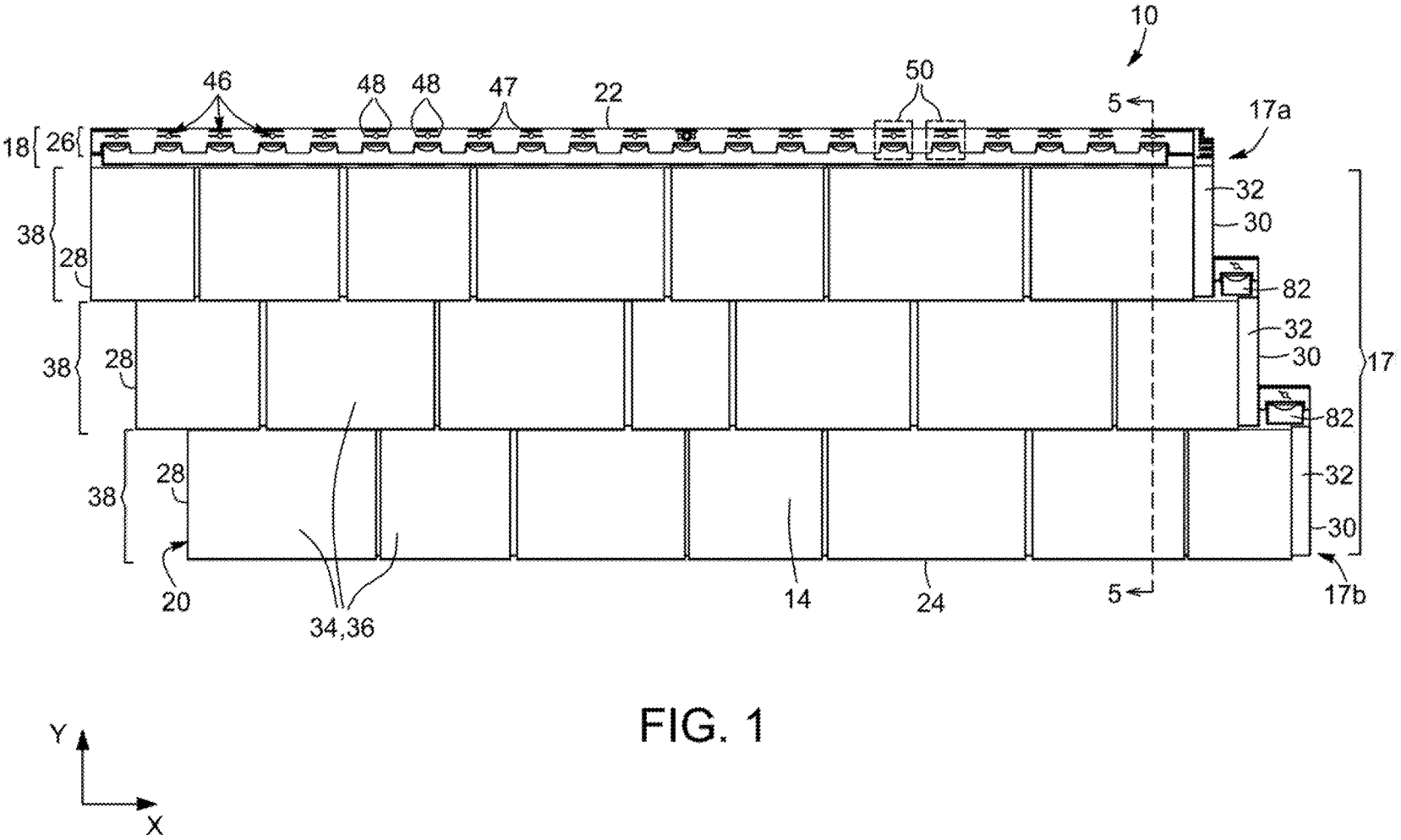
FIG. 1 is a front elevation view of a covering panel, in accordance with an embodiment.
Figure 2:
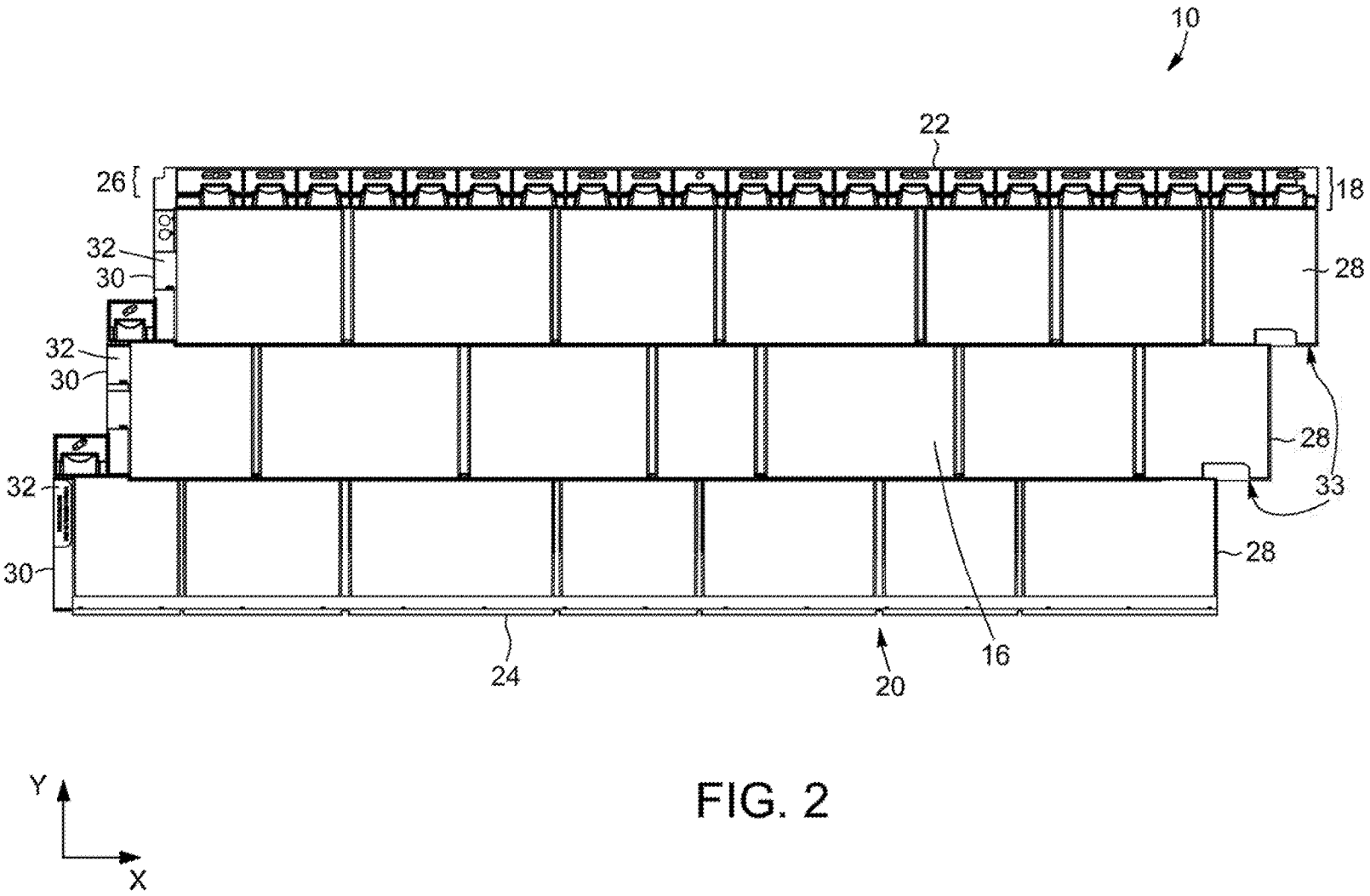
FIG. 2 is a rear elevation view of the covering panel of FIG. 1.

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the covering panel and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, can be used for the covering panel, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Referring generally to FIGS. 1 to 3A, in accordance with one embodiment, there is provided a covering panel 10 for covering a support surface of a bearing substrate 12, which is typically substantially flat, such as, for example and without being limitative a building structure wall, roof or the like. A plurality of covering panels 10 are typically mounted in horizontal courses to the bearing substrate 12. The covering panel 10 is adapted for engagement with other covering panels 10 positioned vertically and horizontally adjacent thereto to cover a section of the bearing substrate 12.

The covering panel 10 includes a front surface 14 and a rear surface 16. The rear surface 16 is opposed to the front surface 14 and faces the substrate 12 when the covering panel 10 is secured thereto. Along a longitudinal axis X, the covering panel 10 can be divided into a plurality of sections. It includes a covering section 17, which is a section of the covering panel 10 which is exposed when the covering panel 10 is mounted to the bearing substrate 12 in successive vertically adjacent and horizontally extending rows of covering panels 10. The covering section 17 is the section of the covering panel 10 covering the bearing substrate 12 to shield it from environmental elements such as rain, wind and the like. The covering panel 10 further includes an upper marginal edge section 18 including an upper edge 22 of the covering panel 10 and an opposed lower marginal edge section 20 including a lower edge 24 of the covering panel 10. In an embodiment, the upper marginal edge section 18 has a substantially uniform width along the longitudinal axis X of the covering panel 10 and includes a fastener strip 26 adapted to be juxtaposed to the bearing substrate 12, when the covering panel 10 is fastened thereto, as will be described in more details below. The covering section 17 extends below the adjacent upper marginal edge section 18. The upper marginal edge section 18 of a first covering panel is covered by the lower marginal edge section 20 of a vertically-adjacent covering panel when the two adjacent covering panels 10 are engaged together, with the covering section 17 of the first covering panel being exposed. The covering panel 10 also includes opposite lateral edges 28, 30, a lateral flange 32 extending from one lateral side of the covering section 17 and including one of the lateral edges 30 and a lateral section 33 extending from the other lateral side of the covering section 17, opposed to the lateral flange 32, proximate to the other lateral edge 28. Similarly to the fastener strip 26, in an embodiment, the lateral flange 32 is juxtaposed to the substrate 12 when the covering panel 10 is secured therewith.

In the embodiment shown in FIG. 1, each one of the lateral edges 30 and the lateral flange 32 includes respectively three separated edge sections and three separated lateral flange sections. However, one skilled in the art will understand that, in alternative embodiments (not shown), a different number of separated lateral flange sections can be provided (i.e. one, two, or more separated lateral flange sections can be provided). For instance, the covering panel 10 can be substantially rectangular in shape with two spaced-apart lateral edges 28, 30 extending substantially continuously between the upper and the lower marginal edge sections 18, 20.

In the embodiment shown, on the front surface 14 of the covering panel 10, at least in the covering section 17, there is provided one or more simulated building elements 34. In an embodiment, a section of the upper marginal edge section 18, for instance the section extending below the fastening strip 26, also includes simulated building elements 34. The front surface 14 can include any type of simulated building elements such as wood planks, slates, tiles, bricks, stones, shingles and the like, each having different textures and appearances. In the embodiment shown, the front surface 14 of the covering panel 10 is designed to represent a plurality of vertically adjacent, horizontally extending rows of shingles 36. In the embodiment shown, the building elements 34 are therefore provided along horizontal successive rows 38, each row being staggered relative to an adjacent row 38. Moreover, the lateral edges 28, 30 of the covering panel 10 are in stepped arrangement, to accommodate the staggered rows 38. One skilled in the art will understand that, in alternative embodiment (not shown), other configurations, such as, for example and without being limitative, vertical columns of building elements 34, non-staggered configuration of rows 38, or the like can also be provided.

The covering panel 10 can be made of any material known to be employed as a covering material for roofing, siding, or the like, such as, for example and without being limitative, a synthetic polymeric material. Moreover, it will be understood that while each covering panel 10 of the embodiment shown is a monolithic (i.e. a single piece) structure, such construction is only exemplary and each covering panel 10 can, in an alternative embodiment (not shown), comprise a unitary structure manufactured from two or more separate constituent components. Furthermore, the length and the height of the covering panel 10 can be varied in accordance with the user's needs.

Referring to FIGS. 1 to 3B, the covering section 17 of the covering panel extends downwardly from the upper marginal region 18, i.e. between the upper marginal edge section 18 and the lower edge 24 of the covering panel 10. In other words, as mentioned above, the covering section 17 extends along the portion of the covering panel 10 located below the upper marginal edge section 18. In an embodiment, and as will be described in more details below, the covering section 17 is arcuate and extends downwardly and outwardly, with a concave curvature, relative to the bearing substrate 12 onto which the covering panel 10 is mounted.

Figure 3A:
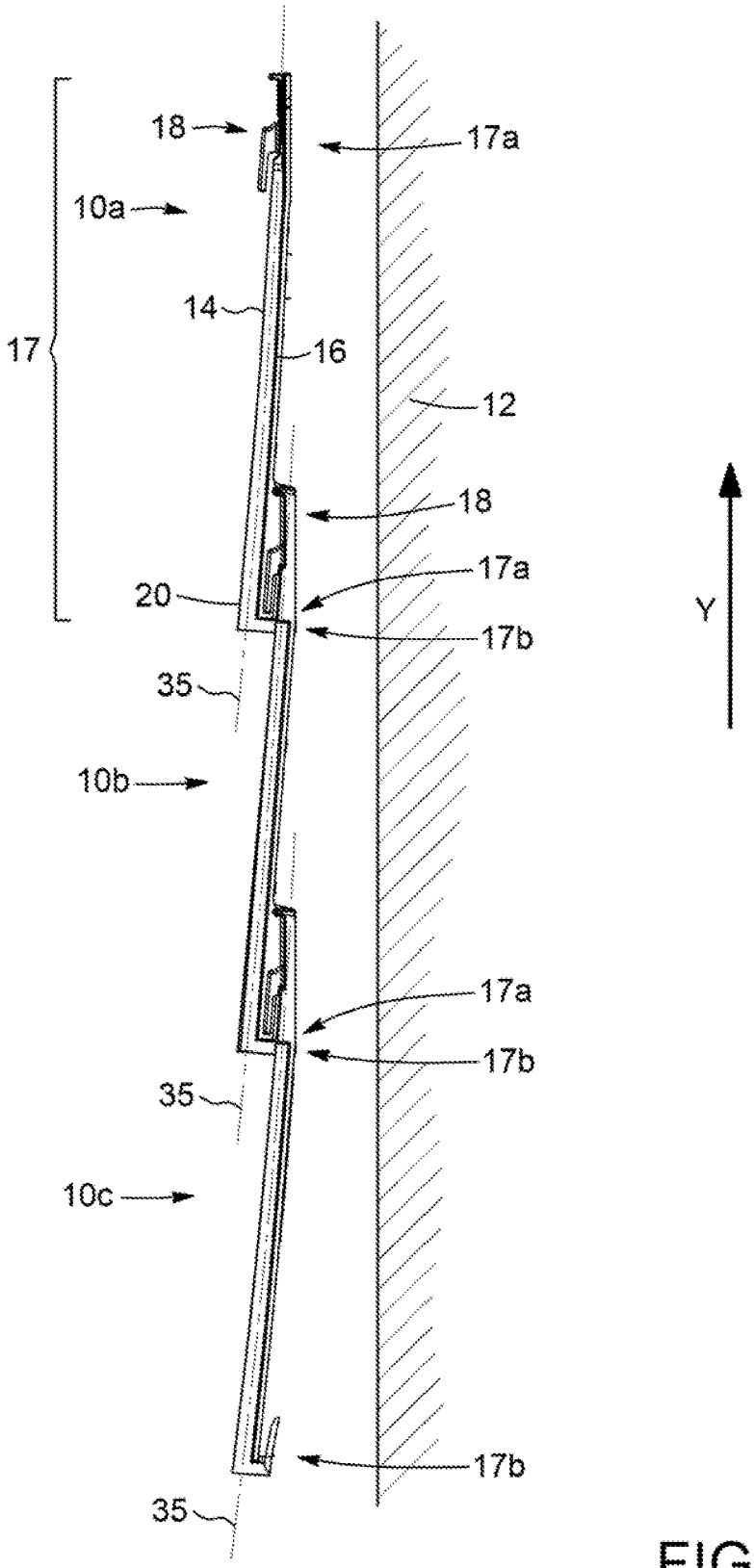
FIG. 3A is a side elevation view of the covering panel of FIG. 1 interlocked with vertically adjacent covering panels and adjacent to a bearing substrate, in accordance with an embodiment.

Referring to FIG. 3A, where three covering panels 10*a*, 10*b*, 10*c* are shown interlocked with one another horizontally, in an embodiment, the covering section 17 of each covering panel 10*a*, 10*b*, 10*c* is characterized by a substantially continuous concave curvature a transverse axis Y defining a continuously extending arch 35 over a height of the covering section 17. In other words, in such an embodiment, the curvature of the covering section 17 of each one of the covering panel 10*a*, 10*b*, 10*c* is substantially continuous from a lower end 17*b* thereof (i.e. from a section proximate to the lower edge 24 of the panel 10) to an upper end 17*a* thereof (i.e. to a section proximate to a lower end of the upper marginal region 18 of the panel 10) thereby providing a concavity to the covering panel 10.

Each one of the covering panels 10*a*, 10*b* and 10*c* has a curvature defined along the covering section 17 thereof. Covering panels 10*a*, 10*b* are configured such that when they are mounted to the bearing substrate 12 and the first covering panel 10*a* is positioned vertically adjacent and above the second covering panel 10*b*, the lower marginal edge section 20 of the first covering panel 10*a* overlies the upper marginal edge section 18 of the second vertically-adjacent covering panel 10*b*. A similar configuration is provided between the second covering panel 10*b* and the third covering panel 10*c* and any other additional covering panel 10.

Figure 3B:
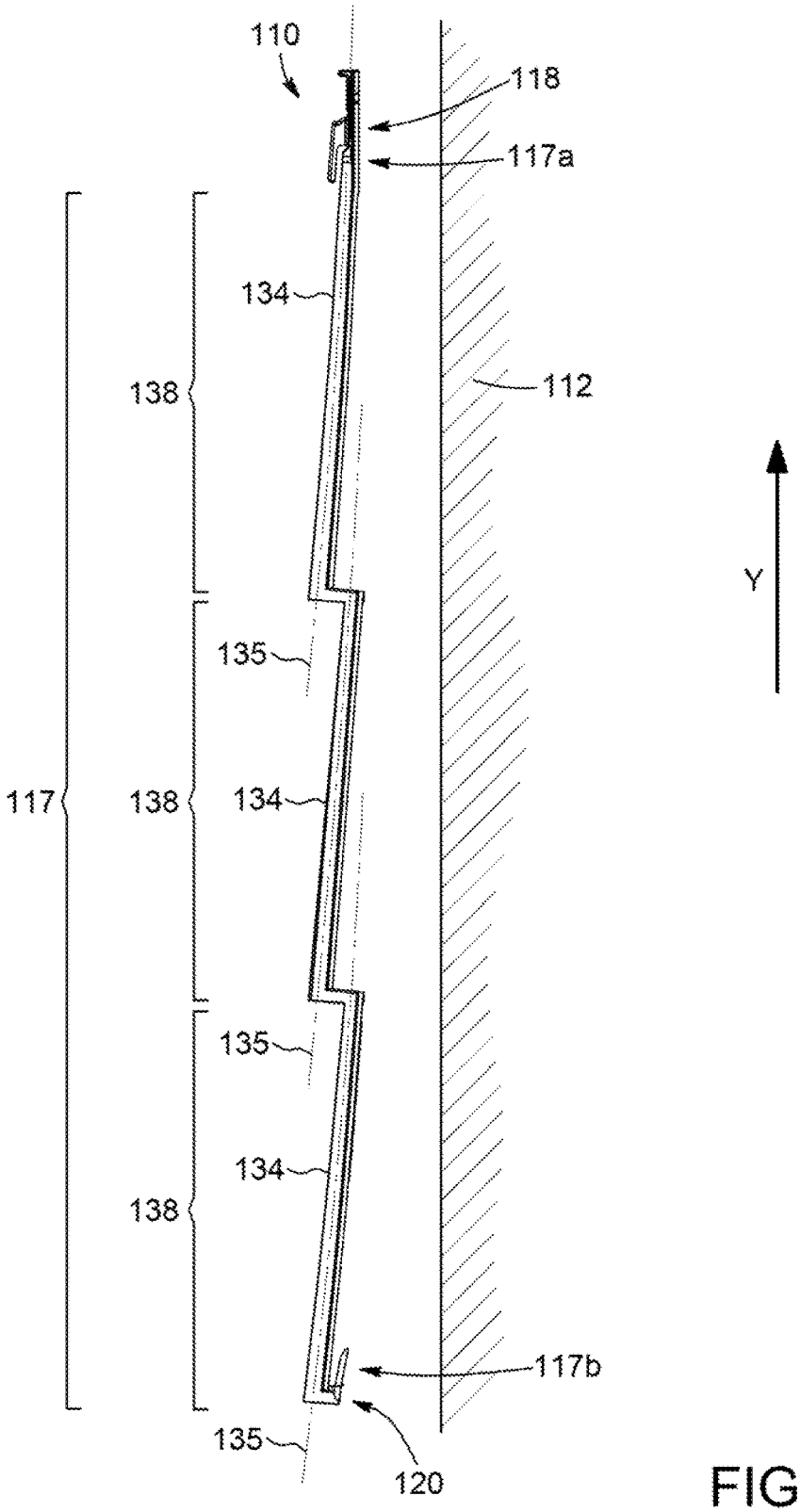
FIG. 3B is a side elevation view of the covering panel of FIG. 1 and including building elements provided along horizontal successive rows, in accordance with an embodiment.

Referring to FIG. 3B, there is shown an alternative embodiment where a single covering panel 110 is shown and similar features are numbered using the same reference numerals in the 100 series. In the alternative embodiment of FIG. 3B, each row 138 of building elements 134 of the covering section 117 can include a concave curvature along the transverse axis Y and defining the continuously extending arch 135. In such an embodiment, the overall curvature is defined by the combination of the curvature of each row 138 of building elements 134 of the covering section 117 such that the overall curvature extends downwardly along the panel 110 and outwardly with regards to the bearing substrate 112 and includes a plurality of succeeding curvatures. The sum of curvatures of each row 138 results in a covering section 117 having a downwardly and outwardly extending curvature relative to the bearing substrate 212 onto which the covering panel 110 is mounted and extending between the upper end 117*a* and lower end 117*b* of the covering section 117. In such an embodiment, the curvature of each row 138 provides a concavity to the corresponding row of the covering panel 110.

In order to ease the reading of the present description, only the reference numbers in the 10 series will be used in the description below, unless specific reference to the embodiments of FIG. 3A or FIG. 3A is made. One skilled in the art will however understand that, in general, the reference numbers in the 10 series include reference to corresponding reference numbers in the 100 series, when appropriate. Thus, the features of the covering panel detailed below apply to the covering panels 10, 110 shown in FIGS. 3A and 3B.

In view of the above, in both of the embodiments shown in FIGS. 3A and 3B, when the upper marginal region 18 of the covering panel 10 is secured to the substrate 12, the curvature of the covering section 17 results in a deflection of the covering section 17 or deflection of each one of the rows 38 of the covering section 17. In other words, the curvature of the covering section 17 results in one or several section(s) of the covering section 17 being spaced apart from the bearing substrate 12. In the embodiment of FIG. 3A, where the curvature is substantially continuous along the transverse axis Y, for the entire covering section 17, the covering section 17 is spaced apart from the substrate 12 at a lower end thereof, i.e. close to the lower marginal edge region 20. In the embodiment of FIG. 3B where the covering section 117 includes a plurality of horizontal rows 138 of simulated building elements 134, each one of the rows 138 can be arcuate with an upper section of each one of the rows 138 being closer to the bearing substrate 112 than a corresponding lower section of each one of the rows 138. Hence, in such an embodiment, the covering section 117 is spaced apart from the substrate 112 at a lower end of each one of the rows 138 when the covering panel 110 is secured to the bearing substrate 112.

In an embodiment, the deflection of the covering section 17 or the deflection of each one of the rows 38 of the covering section 17 is between about 1/16 of an inch and about 1 inch. In other words, in an embodiment, the curvature of the covering section 17 can be such that when the upper marginal region 18 is juxtaposed and secured to the substrate 12, as will be described in more details below, the lower end 17*b* of the covering section 17 is spaced apart from the substrate 12 by a distance of between about 1/16 of an inch and about 1 inch. Similarly, the curvature of each one of the rows 38 of the covering section 17 can be such that when the upper marginal region 18 is juxtaposed and secured to the substrate 12, a lower end of each one of the rows 38 is spaced apart from the substrate 12 by a distance of between about 1/16 of an inch and about 1 inch. In an embodiment, the deflection of the entire covering section 17 or the deflection of each one of the rows 38 of the covering section 17 is independent of the height of the covering panel (i.e. the deflection of the entire covering section 17 is between about 1/16 of an inch and about 1 inch regardless of the height of the covering section 17 or the rows 38 thereof).

One skilled in the art will understand that the overall curvature defined in the covering section 17 of the covering panel 10, between the upper end 17*a* and the lower end 17*b* thereof, increases a length of the covering panel 10 abutting or being close to the bearing substrate 12 along the transverse axis Y, when the covering panel 10 is mounted thereto. In other words, such curvature results in a greater section of the covering panel 10 abutting or being close to the bearing substrate 12 as opposed to conventional substantially planar panel along the transverse axis Y. Therefore, when momentary pressure is applied on the covering panel 10, the springback effect is reduced in comparison to conventional substantially planar panel defining an oblique angle with the bearing substrate 12 when mounted thereto.

Figure 4:
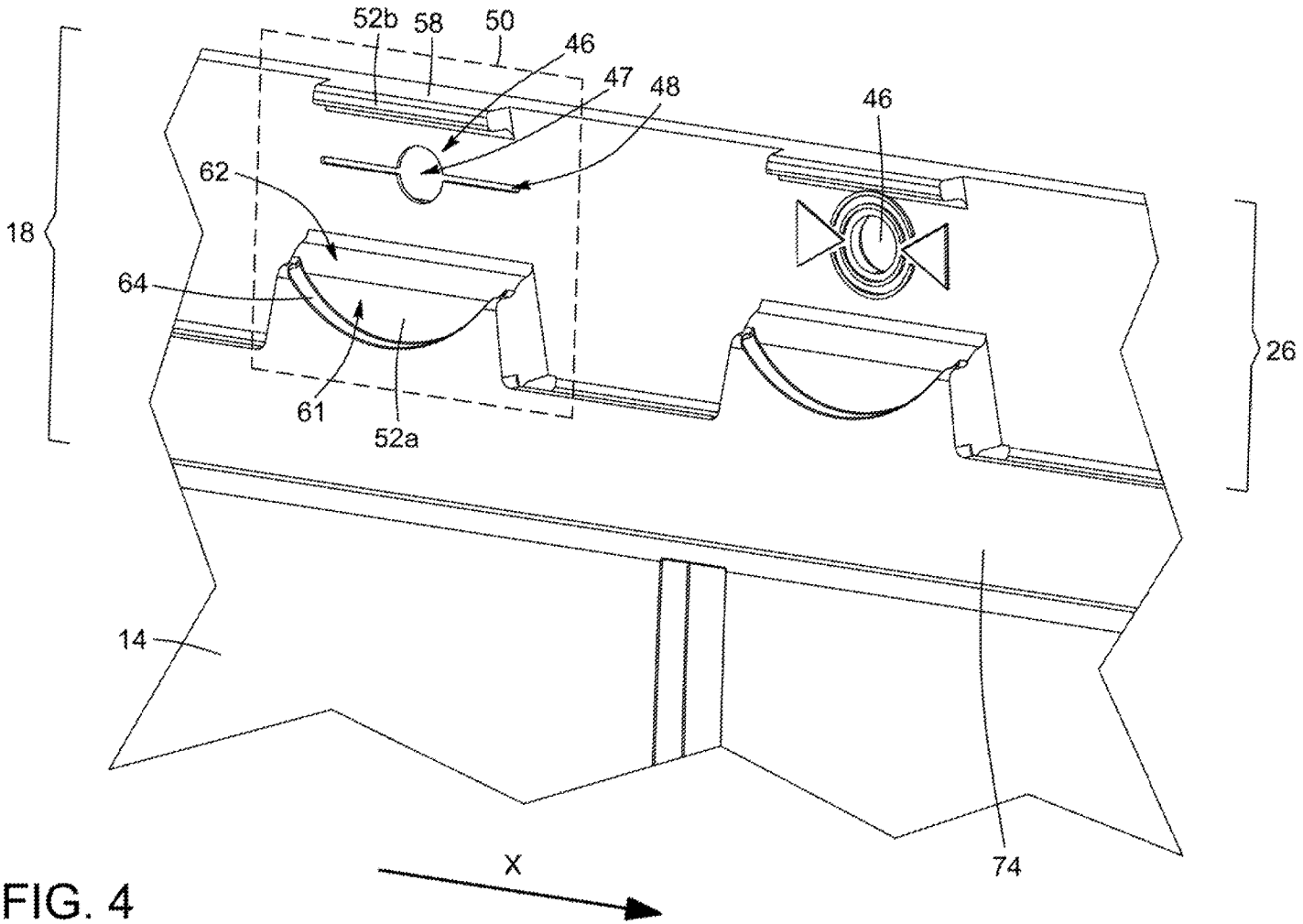
FIG. 4 is a perspective partial view, enlarged, of an upper portion of the covering panel of FIG. 1 showing a hammer stop in accordance with an embodiment.
Figure 5:
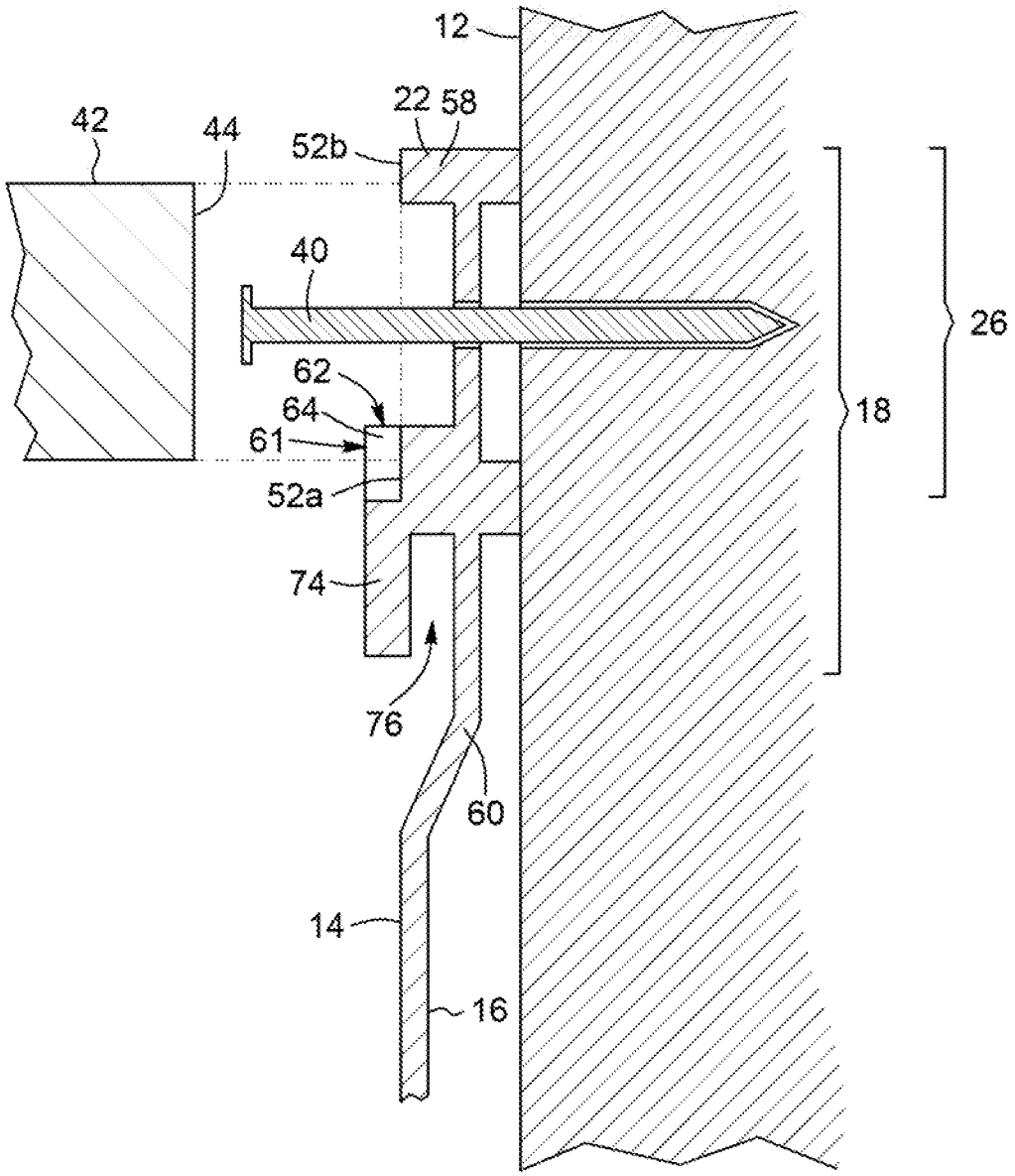
FIG. 5 is a cross sectional view, enlarged, of a portion of the covering panel taken along the lines 5-5 of FIG. 1 illustrating a hammer head aligned with the hammer stop.

Now referring to FIGS. 1, 4 and 5, the covering panel 10 is securable to the substrate 12 using mechanical fasteners 40 driven into the bearing substrate 12. In an embodiment, the mechanical fastener 40 is a nail driven into the substrate 12 by a hammer 42 having a hammer head 44. As mentioned above, the covering panel 10 includes the fastener strip 26 in the upper marginal edge region 18. One skilled in the art will understand that when the covering panel 10 is secured to the bearing substrate 12 by the fasteners 40, the fastener strip 26 is substantially juxtaposed to the bearing substrate 12.

In an embodiment, in order to help secure the covering panel 10 to the bearing substrate 12, the fastener strip 26 includes a plurality of fastener apertures 46, spaced-apart from one another, and provided along the longitudinal axis X of the fastener strip 26. In an embodiment, the plurality of fastener apertures 46 are located along at least the upper marginal edge section 18. Each one of the fastener apertures 46 includes a main aperture 47 sized and shaped to allow the shank of the fastener 40 to move freely therethrough and into the adjacent substrate 12. In an embodiment, each fastener aperture 46 further includes elongated fastener slots 48 extending laterally from the main aperture 47 and defined by slits or elongated grooves in the layer of material of the covering panel 10. As can be seen in FIG. 4, the elongated fastener slots 48 are laterally extending along the direction of the longitudinal axis X and are characterized by smaller transverse dimensions than the main aperture 47 so as to allow easy identification of the preferred approximate location for positioning the fastener 40 in the fastener aperture 46. In other words, the elongated fastener slots 48 have a width smaller than the diameter of the main aperture 47. In an embodiment, the layer of material about the elongated fastener slots 48 can be sufficiently thin so as to allow relative movement between the fastener 40 extending into the fastener aperture 46 and the covering panel 10, as can be occasioned by changes in ambient environmental temperature causing expansion and/or contraction of the polymer material of the covering panel 10.

Now referring to FIGS. 4 to 6, in order to allow engagement of two vertically adjacent panels, as will be described in more details below, the covering panel 10 further includes a vertical interconnection tab 74 projecting downwardly from the fastener strip 26, in the upper marginal edge section 18. The vertical interconnection tab 74 defines an upwardly-extending engagement slot 76. In the embodiment shown, the covering section 17 is connected to the fastener strip 26 by a plurality of spaced-apart connecting walls 60 (see FIG. 6), with the vertical interconnection tab 74 extending forwardly of the connecting walls 60. The upwardly-extending engagement slot 76 is defined between the vertical interconnection tab 74 and the connecting walls 60. In the embodiment shown (see FIG. 6), the connecting walls 60 are spaced-apart by indentations 63 defined in a section located between the covering section 17 and the fastener strip 26. However, one skilled in the art will understand that, in an embodiment (not shown), the covering panel 10 can include a single connecting wall 60 extending continuously between both lateral edges 28, 30 of the covering panel 10.

In the embodiment shown, the vertical interconnection tab 74 further includes a plurality of recesses 61, each defining a hammer head stop surface 52*a*, and a corresponding contouring wall 64. Each one of the recesses 61 is positioned below a corresponding one of the fastener apertures 46. As will be described in more details below, the contouring wall 64 is positioned and configured to define a hammer head alignment guide 62.

In the embodiment shown, in the upper marginal edge section 18, the covering panel 10 further includes a plurality of spaced-apart upper ridges 58 protruding from the fastener strip 26 and each defining a hammer head stop surface 52*b*. In the embodiment shown, each one of the upper ridges 58 extends above a corresponding one of fastener apertures 46, i.e. between the fastener apertures 46 and the upper edge 22 of the covering panel 10. Each one of the upper ridges 58 is substantially aligned with a respective one of the recesses 61 along the longitudinal axis X. One skilled in the art will understand that, in an alternative embodiment (not shown), upper ridges 58 having a hammer head stop surface 52*b* and being spaced apart from the recesses of the vertical interconnection tab 74 can be provided with a different position or configuration than those of the embodiment shown. For example and without being limitative, the covering panel 10 can include a single upper ridge 58 extending continuously or discontinuously between both lateral edges 28, 30 of the covering panel 10, rather than a plurality of spaced-apart upper ridges 58, each one being substantially aligned with a corresponding one of the recesses 61.

The combination of the hammer head stop surfaces 52*a* of the recesses 61 of the vertical interconnection tab 74 and the hammer head stop surfaces 52*b* of the corresponding upper ridge 58 together define a hammer head stop 50. It is appreciated that, in an embodiment where the upper ridge 58 extends continuously over more than one recess 61 of the covering panel 10, a hammer head stop 50 is defined by the hammer head stop surfaces 52*a* of the recesses 61 of the vertical interconnection tab 74 and a corresponding section of the hammer head stop surface 52*b* of upper ridge 58.

The hammer head stops 50 are positioned relative to the corresponding ones of the plurality of fastener apertures 46 to allow positioning and alignment of the hammer head 44 above the fastener strip 26 and to limit the depth to which a fastener 40 can be driven through each fastener apertures 46 and into the bearing substrate 12. Each hammer head stop 50 includes elevated hammer head stop surfaces 52*a*, 52*b* protruding from a section of the front surface 14 of the fastener strip 26 including the fastener apertures 46. Each hammer head stop 50 is configured to be abutted by the hammer head 44, at a distance from the section of the front surface 14 of the fastener strip 26 including the fastener apertures 46. In the embodiment shown, the hammer head stop surfaces 52*a*, 52*b* are substantially aligned with and positioned on a respective side of each fastener aperture 46. The hammer head stop surfaces 52*a*, 52*b* extend forwardly of the section of the front surface 14 of the fastener strip 26 including the fastener apertures 46, i.e. along an axis extending substantially normal to the covering panel 10 and to the bearing substrate 12 to which the panel 10 is secured. In other words, the hammer head stop surfaces 52*a*, 52*b* are elevated from the section of the front surface 14 of the fastener strip 26 including the fastener apertures 46. The hammer head stop surfaces 52*a*, 52*b* are configured to be abutted by the hammer head 44 at a predetermined distance of the section of the front surface 14 of the fastener strip 26 including the fastener apertures 46, as defined by the elevation thereof. In an embodiment the hammer head stop surfaces 52*a*, 52*b* are substantially levelled to one another. It will be understood that the term "level" is used herein to refer to an elevation of the hammer head stop surfaces 52*a*, 52*b* defining the distance of the hammer head stop surfaces 52*a*, 52*b* with regards to a distance defined with the section of the front surface 14 of the fastener strip 26 including the fastener apertures 46. The hammer head stop surfaces 52*a*, 52*b* being substantially levelled allows the fastener 40 to be driven substantially perpendicularly through the fastener apertures 46 relative to the front surface 14 of the covering panel 10, when the hammer head 44 confronts or abuts both hammer head stop surfaces 52*a*, 52*b*. One skilled in the art will understand that, in alternative embodiments, the hammer head stop surfaces 52*a*, 52*b* can be unlevelled, i.e. the elevation of the hammer head stop surfaces 52*a*, 52*b* can be different from one another in order to result in the fastener 40 being driven at an oblique angle into the bearing substrate 12. Furthermore, one skilled in the art will understand that, in an alternative embodiment, the hammer head stops 50 can include only the hammer head stop surface 52*a* defined by the recesses 61 of the vertical interconnection tab 74.

It will be understood that the hammer head stop surfaces 52*a*, 52*b* together act so as to confront or abut and level the head 44 of a hammer 42 having a hammer head 44 diameter greater than the distance between the hammer head stop surfaces 52*a*, 52*b* of the hammer head stop 50. In view of the above, when installation of the covering panel 10 is performed using a hammer 42, such as and without being limitative, a pneumatic hammer, having a hammer head 44 diameter greater than the distance between the opposing hammer head stop surfaces 52*a*, 52*b*, the fastener 40 can be driven through the fastener apertures 46 and into the underlying bearing substrate 12 only to a depth which leaves sufficient space for the covering panel 10 to move relative to the fastener 40 during expansion and contraction of the covering panel 10.

Figure 6:
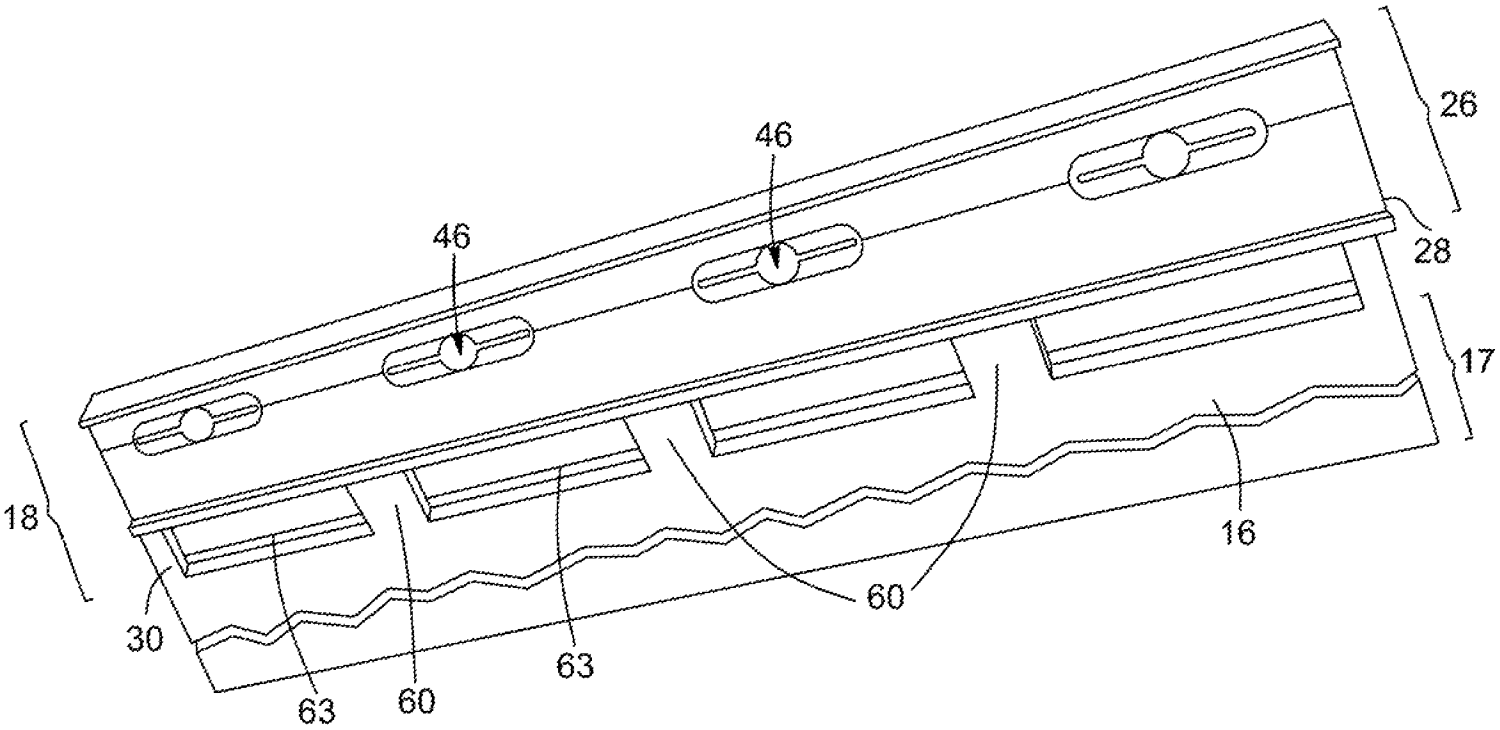
FIG. 6 is a rear perspective view, enlarged, of a portion of the upper marginal edge section of the covering panel of FIG. 1 showing a connecting wall of the covering panel in accordance with an embodiment.
Figure 7:
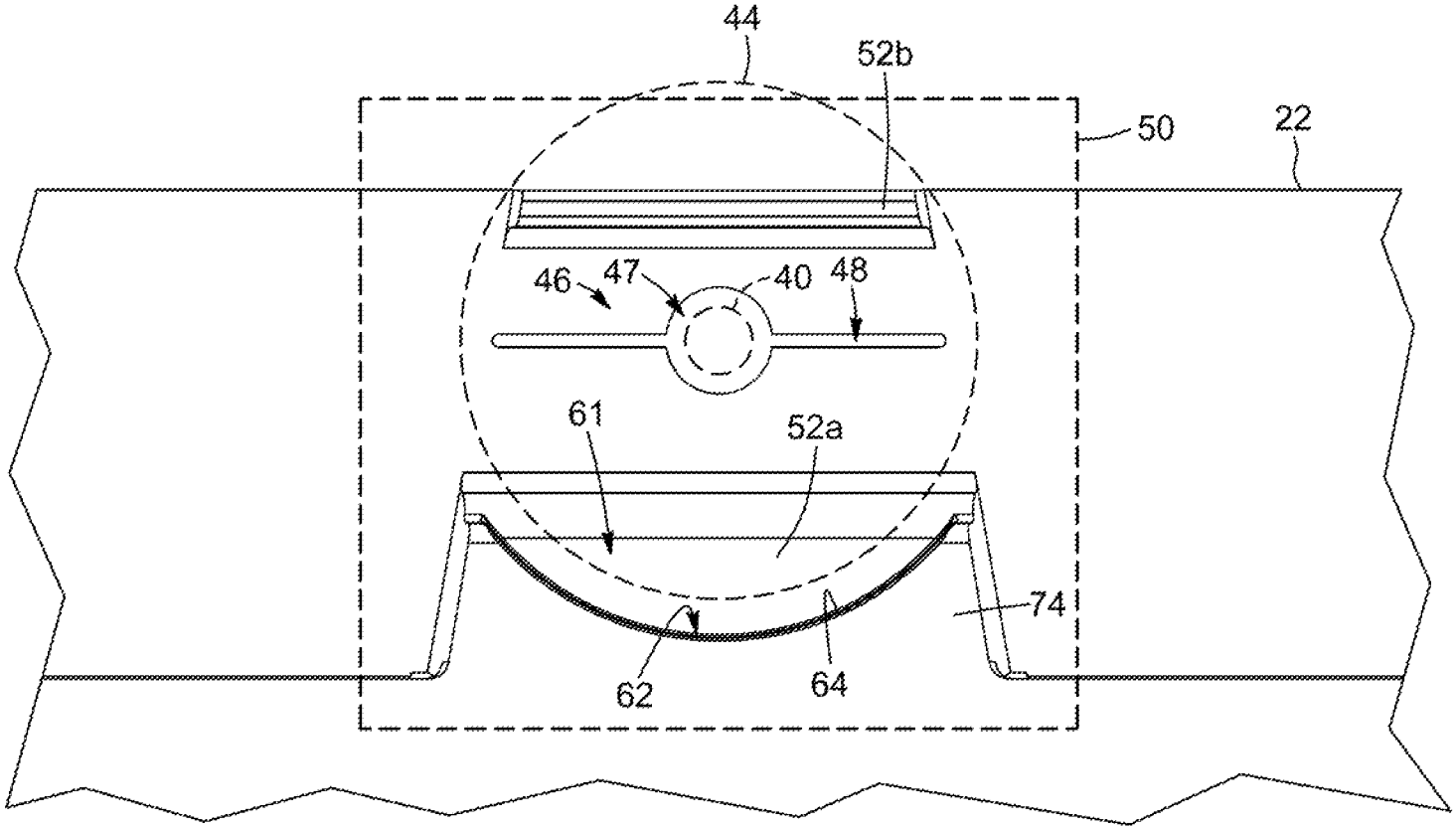
FIG. 7 is a front elevation view, enlarged, of a section of the upper marginal edge section of the covering panel of FIG. 1.

Still referring to FIGS. 4 to 6, as mentioned above, the contouring wall 64 of the corresponding recess 61 defines a hammer head alignment guide 62 configured to position the hammer head 44 in a predetermined position with respect to the fastener aperture 46, such that the fastener 40 is directed through the main aperture 47 of the fastener apertures 46. In an embodiment, the contouring walls 64 protrude outwardly from a respective one of the hammer head stop surface 52*a* positioned below the corresponding flange fastener apertures 46, thereby defining a shelf surface upon which a hammer head 44 can be placed and rested when the hammer 42 is being used to insert the fastener 40 and positioning the hammer head 44 with respect to the fastener apertures 46 by gravity. The contouring wall 64 defines a concave surface adapted to the corresponding size and shape of a contour of the hammer head 44 of the hammer to be used for driving the mechanical fastener used for mounting the covering panel 10 to the bearing substrate 12. In other words, in an embodiment, the contouring wall 64 is sized and shaped to receive therein a portion of the hammer head 44 of a hammer 42 and guide the hammer head 44 in proper position, by gravity, to result in the fastener 40 being driven through the main aperture 47 of the fastener apertures 46. In the embodiment shown, the concave surface of the contouring wall 64 of the hammer head alignment guide 62 is curvilinear. One skilled in the art will understand that the shape and configuration of the hammer head alignment guide 62 defined by the contouring wall 64 can vary from the embodiment shown. For instance and without being limitative, in the embodiment shown, the bottom of the contouring wall 64 is substantially aligned with the fastener aperture 46 along the longitudinal axis X and is sized and shaped to receive the hammer head of pneumatic hammers manufactured by Bostitch® and Hitachi®. However, the contouring wall 64 could have a different configuration to receive the hammer head of different pneumatic hammer manufacturers.

Figure 8:
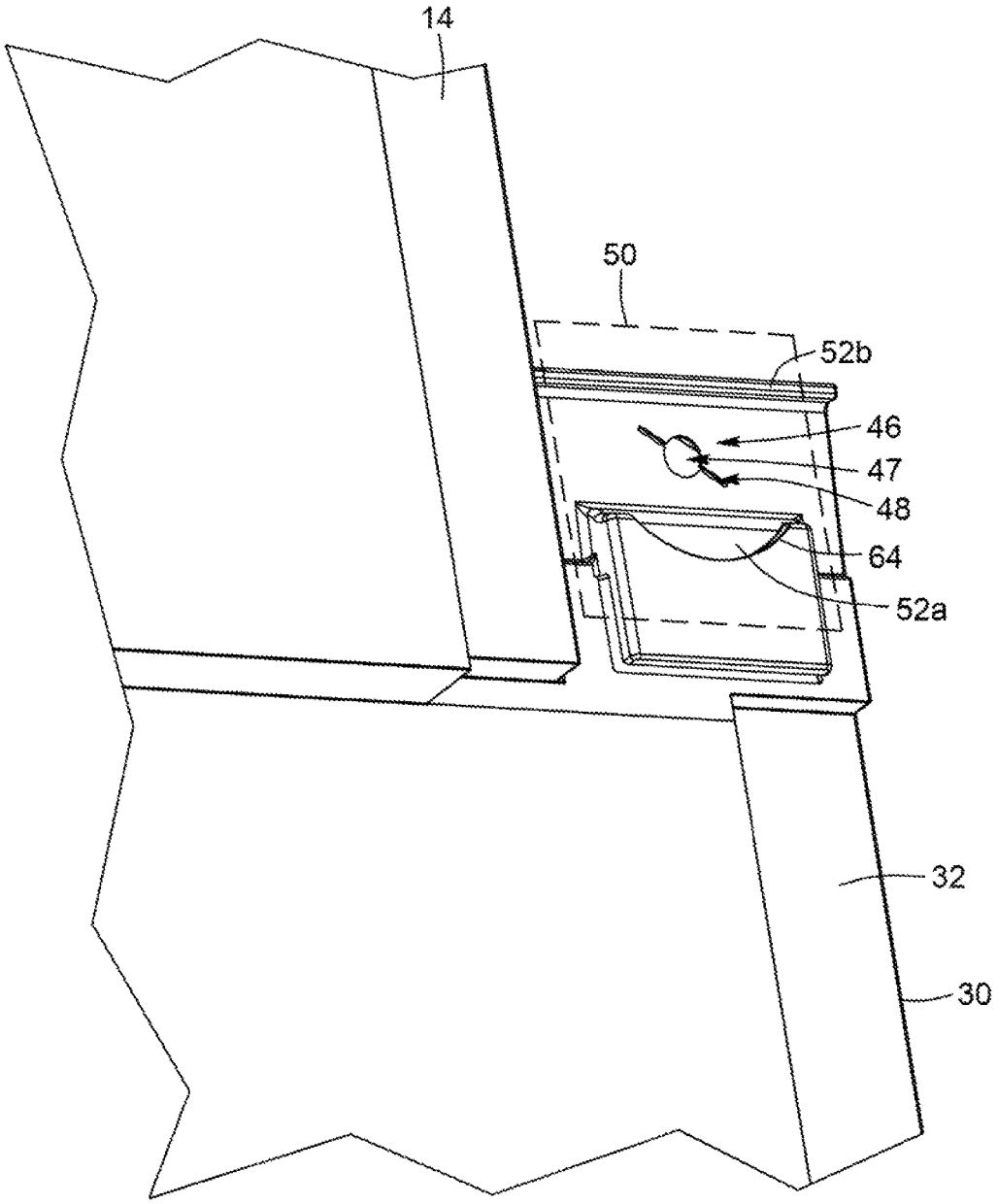
FIG. 8 is a front perspective view, enlarged, of the lateral flange of the covering panel of FIG. 1 showing a hammer stop provided on a lateral flange.

Now referring to FIGS. 1 and 8, in an embodiment the lateral flange 32 of the covering panel 10 also includes at least one flange fastener aperture 46 having an elongated lateral fastener slot 48. Each one of the flange fastener apertures 46 has an associated flange hammer stop 50 for positioning and aligning the hammer head 44 above the lateral flange 32, to limit the depth to which a fastener 40 can be driven into each flange fastener apertures 46 and into the substrate 12. The flange fastener aperture 46 and associated flange hammer stop 50 are similar to the ones described above with regards to those of the fastener strip 26. Each flange hammer head stop 50 includes elevated flange hammer head stop surfaces 52*a*, 52*b* protruding from the lateral flange 32, with the flange hammer head stop surfaces 52*a*, 52*b* being elevated from the lateral flange 32, and configured so as to confront or abut the hammer head 44 at a distance from a section of the lateral flange 32 including the flange fastener aperture 46. The flange hammer head stop surfaces 52*a*, 52*b* are aligned with and positioned on a respective side of each lateral flange fastener aperture 46. Once again, a contouring wall 64 defines a flange hammer head alignment guide 62 configured to position the hammer head 44 with respect to the fastener aperture 46.

Now referring to FIGS. 4 to 8, in an embodiment, the covering panel 10 is securable to the bearing substrate 12 in a manner as will be described in more details below. In order to secure the covering panel 10 to the bearing substrate 12, the hammer head 44 of a pneumatic hammer is brought into abutting contact within the hammer stop 50 provided on the fastener strip 26 such that the hammer head 44 abuts or confronts the head stop surfaces 52*a*, 52*b* to position the hammer head 44 at a distance from the section of the fastener strip 26 including the fastener apertures 46. When the hammer head 44 is brought into abutting contact with a hammer stop 50, the hammer head alignment guide 62 further positions the hammer head 44 with respect to the fastener aperture 46. As a result of such an alignment and positioning of the hammer head 44 by the hammer stop 50, the fastener 40 can subsequently be driven by the hammer 42 towards and through the fastener aperture 46. In an embodiment, the contouring walls 64 provide a support surface (or shelf surface) upon which the hammer head 44 can be placed and rested to temporarily support the weight of the hammer 42 while it is being used to insert the fastener 40. The covering panel 10 is fully mounted to the bearing substrate 12 by repeating the above described steps for each (or any other number) fastener apertures 46 provided on the fastener strip 26.

In an embodiment where fastener apertures 46 are also provided along the lateral flange 32, the hammer 42 is also brought into abutting contact with the flange hammer stops 50 provided on the lateral flange 32 such that the hammer head 44 abuts or confronts the flange hammer head stop surfaces 52*a*, 52*b* to position the hammer head 44 at a distance from the section of the lateral flange 32 including the flange fastener aperture 46. Once again, when the hammer 42 is brought into abutting contact with the flange hammer stop 50, the flange hammer head alignment guide 62 further positions the hammer head 44 in the predetermined position with respect to the flange fastener aperture 46. As a result of such an alignment and positioning of the hammer head 44 by the flange hammer stop 50, the fastener 40 is able to be driven by the hammer 42 towards and through the flange fastener aperture 46 of the lateral flange 32. Similarly, the covering panel 10 is fully mounted to the substrate 12 by repeating the above described steps for each (or any other number) flange fastener apertures 46 provided on the lateral flange 32.

As mentioned above, the covering panels 10 include interlocking features that enable inter-engagement of overlying upper marginal edge sections 18 and lower marginal edge sections 20 during installation of the covering panel 10 over the substrate 12 to vertically connect adjacent covering panels 10. In an embodiment, vertically-adjacent covering panels 10 are engaged together by inserting an insertable flange (not shown) provided on the rear surface 16 of the lower marginal edge section 20 into the upwardly-extending engagement slot 76 defined between the vertical interconnection tab 74 and the connecting walls 60, as it is known in the art.

Figure 9:
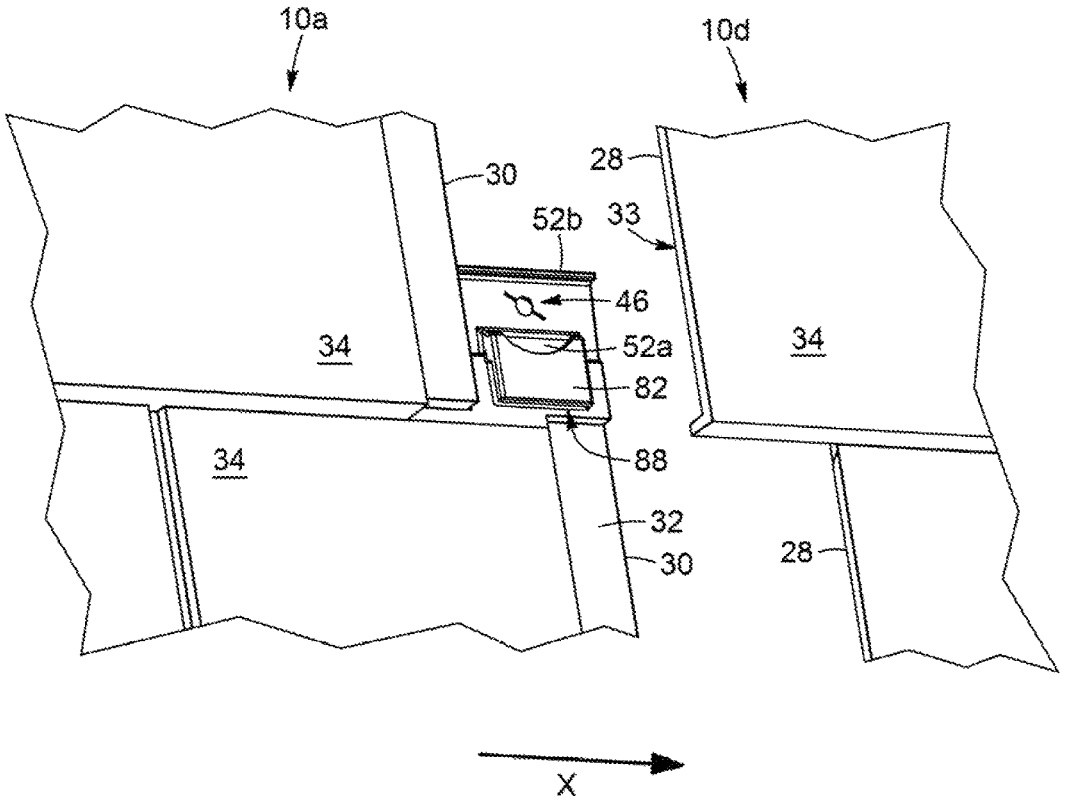
FIG. 9 is a front perspective view of the lateral flange of the covering panel of FIG. 1 showing an interlocking tab including the hammer stop in accordance with an illustrative embodiment.
Figure 10:
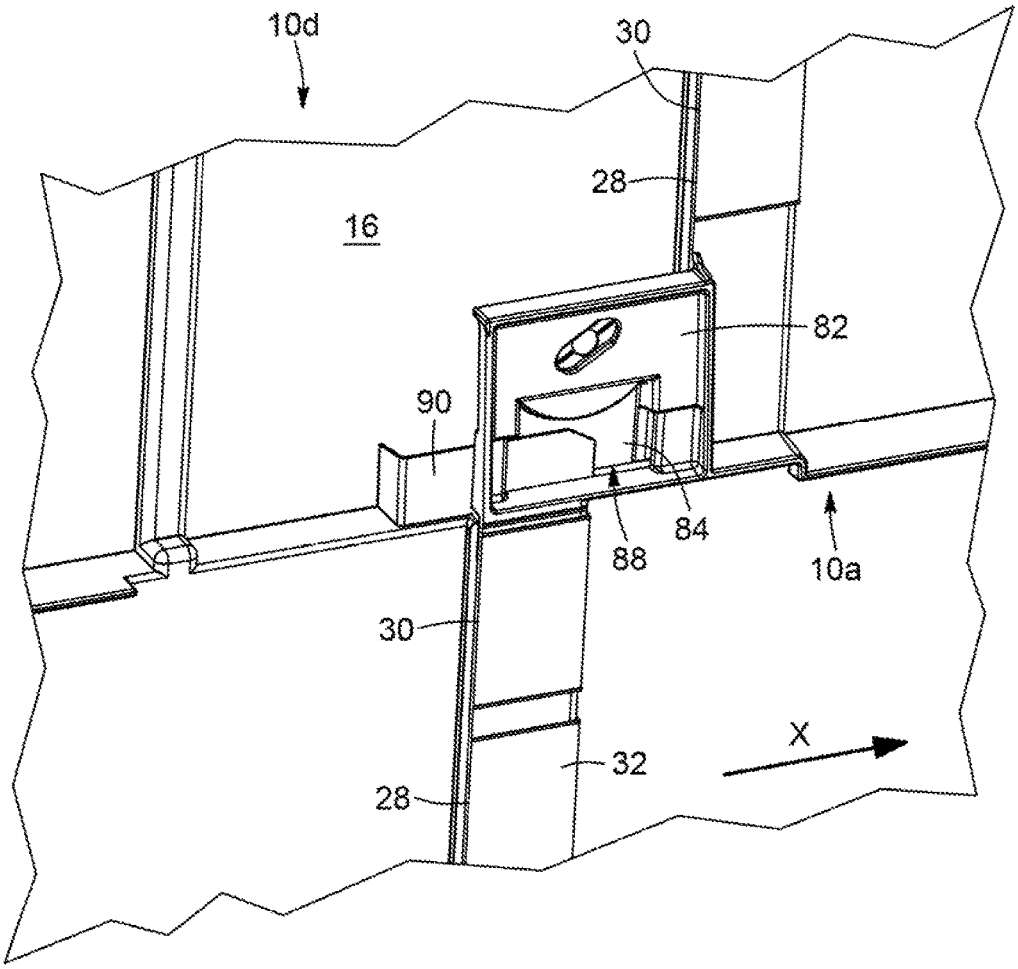
FIG. 10 is a rear perspective view of the lateral flange of the covering panel of FIG. 1 illustrating the interlocking tab in engagement with a hook of a horizontally adjacent panel.

Now referring to FIGS. 1, 9 and 10, the covering panels 10 also include interlocking features allowing interlock of a lateral flange 32 of a first panel to the lateral section 33 of a horizontally-adjacent second panel 10 overlying the lateral flange 32 of the first panel, when the first and second horizontally adjacent covering panels 10 are connected to one another. The inter-engagement of vertically-adjacent covering panels 10 facilitates handling of an overlying covering panel 10 while being secured to the bearing substrate 12.

In the embodiment shown, horizontally-adjacent covering panels 10 are engaged together by a substantially horizontal sliding movement of adjacent covering panels 10, i.e. by a movement of adjacent covering panels along the longitudinal axis X of the panels 10. One skilled in the art will however understand that, in alternative embodiment, other ways of engaging adjacent covering panels 10 together, such as through a vertical, horizontal, or a combination of vertical and horizontal movements is also possible.

In the embodiment shown, the covering panels 10 include at least one lateral interconnection tab 82, positioned on the lateral flange 32. The lateral interconnection tabs 82 include a generally J-shaped jaw 84 extending forwardly of a section of the front surface of the lateral flange 32 towards lower marginal edge section 20 so as to define a lateral engagement slot 88 extending upwardly between the lateral interconnection tab 82 and the lateral flange 32. In the embodiment shown, the flange elevated hammer head stop surfaces 52*a* and the contouring wall 64 of the flange hammer head alignment guide 62 are defined in a front surface of the jaw 84. The covering panels 10 also include a substantially "L"-shaped hook 90 positioned in the lateral section 33 of the covering panels, opposed to the lateral edge 32. The hook 90 extends from the rear surface 16 of the covering panel 10, close to the lateral edge 28 thereof.

The lateral interconnection tabs 82 and the hooks are configured such that the lateral interconnection tab 82 of a first panel 10*a* interlocks with the hook 90 of an adjacent covering panel 10*d*, when the panels are joined and secured to the bearing substrate. Hence, each one of the hooks 90 is sized and shaped to be slidingly received in the lateral engagement slot 88 defined by the lateral interconnection tab 82 of an adjacent covering panel 10*a* (see FIG. 10) through substantially horizontal sliding movement of the covering panels 10*a*, 10*d* (i.e. through displacement of at least one of the covering panels 10*a*, 10*d* along the longitudinal axis X thereof). In the embodiment shown, the hook 90 is defined by a single element, but one skilled in the art will understand that, in an alternative embodiment (not shown), the hook 90 can be formed as one of a plurality of discrete elements positioned along the rear surface 16 adjacent to the lateral edge 28.

As can be seen in FIG. 10, each lateral interconnection tab 82 of a panel 10*a* and hook 90 of an adjacent panel 10*d* is further characterized by dimensions sufficient to allow relative lateral sliding movement of the hook 90 along the lateral engagement slot 88 defined by the lateral interconnection tab 82 of the adjacent covering panel 10*a*, thus facilitating relative sliding movement of adjacent covering panels 10*a*, 10*d* due to thermal expansion and/or contraction. When adjacent covering panels 10*a*, 10*d* are slideably engaged, the lateral flange 32 of a first panel 10*a* is overlied by the opposite lateral section 33 of the horizontally-adjacent covering panel 10*d*. One skilled in the art will understand that, in alternative embodiment (not shown), other assemblies resulting in the interlock of laterally adjacent panels through movement of adjacent covering panels along the longitudinal axis X of the panels 10 lateral can be provided.

It will be appreciated from the foregoing disclosure that the covering panel 10 disclosed herein provides inexpensive and rapid installment of a covering panel using a hammer, such as a pneumatic hammer, to drive fasteners 40 which are properly aligned, positioned, and inserted in the substrate 12 only to a depth which leaves sufficient space for the covering panel 10 to move relative to the fastener 40 during expansion and contraction of the covering panel 10.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A covering panel securable to a bearing substrate using fasteners driven by a hammer having a hammer head having a nailing face and a peripheral face extending rearwardly from the nailing face, the covering panel comprising:

a front surface;

a rear surface opposed to the front surface and facing the bearing substrate when the covering panel is secured thereto;

a fastener strip comprising a plurality of fastener apertures spaced apart along a longitudinal axis of the covering panel, the fastener strip being juxtaposed to the bearing substrate when the covering panel is secured thereto; and a plurality of hammer stops extending forwardly from a section of the fastener strip including the fastener apertures, each one of the hammer stops being associated to a corresponding one of the plurality of fastener apertures and comprising:

at least one elevated hammer head stop surface protruding from the section of the fastener strip including the fastener apertures and elevated therefrom, the at least one elevated hammer head stop surface being configured to abut with the nailing face of the hammer head and maintain the hammer head at a distance from the section of the fastener strip including the fastener apertures; and a hammer head alignment guide abutable with at least a section of the peripheral face of the hammer head to position the hammer head with respect to the corresponding one of the fastener apertures, the hammer head alignment guide being positioned outwardly from the hammer head stop surfaces with regard to the front surface and extending further away from the corresponding one of the fastener apertures than the hammer head stop surfaces, wherein the hammer head alignment guide defined a concave surface.

2. The covering panel of claim 1, wherein the concave surface is curvilinear.

3. The covering panel of claim 1, wherein the hammer head alignment guide is positioned below the corresponding one of the fastener apertures and comprises a shelf surface positioning the hammer head with respect to the corresponding one of the fastener apertures by gravity.

4. The covering panel of claim 1, wherein the at least one elevated hammer head stop surface comprises a first elevated hammer head stop surface extending below the corresponding one of the fastener apertures and a second elevated hammer head stop surface extending above the corresponding one of the fastener apertures.

5. The covering panel of claim 4, wherein the first elevated hammer head stop surface and the second elevated hammer head stop surface are substantially evenly leveled.

6. The covering panel of claim 1, wherein each one of the plurality of fastener apertures comprises a main aperture and elongated fastener slots extending longitudinally from the main aperture, the elongated fastener slots having a width smaller than the diameter of the main aperture.

7. The covering panel of claim 6, wherein a lower portion of the hammer head alignment guide is substantially aligned with the main aperture along the longitudinal axis of the covering panel.

8. The covering panel of claim 1, wherein the covering panel further comprises:

a lateral flange comprising at least one flange fastener aperture, the lateral flange being juxtaposed to the bearing substrate when the covering panel is secured therewith;

at least one flange hammer stop extending forwardly from a section of the lateral flange, each one of the flange hammer stops being associated to a corresponding one of the at least one flange fastener aperture and comprising:

at least one elevated flange hammer head stop surface protruding from the section of the lateral flange and elevated therefrom, the at least one elevated flange hammer head stop surface being configured to abut with the nailing face of the hammer head and maintain the hammer head at a distance from the section of the lateral flange including the at least one flange fastener aperture; and a flange hammer head alignment guide abutable with at least a section of the peripheral face of the hammer head to position the hammer head with respect to the corresponding one of the at least one flange fastener aperture.

9. The covering panel of claim 8, wherein the flange hammer head alignment guide defines a concave surface.

10. The covering panel of claim 9, wherein the concave surface is curvilinear.

11. The covering panel of claim 8, wherein the flange hammer head alignment guide is positioned below the corresponding one of the flange fastener apertures and comprises a shelf surface positioning the hammer head with respect to the corresponding one of the fastener apertures by gravity.

12. The covering panel of claim 8, further comprising a lateral section opposed to the lateral flange along the longitudinal axis of the covering panel, wherein the lateral flange comprises at least one lateral interconnection tab having a jaw extending forwardly of a section of the lateral flange and defining a lateral engagement slot and wherein the lateral section has a hook extending rearwardly from a section thereof, the lateral interconnection tab and the hook being configured for the lateral engagement slot of the lateral interconnection tab of a first covering panel to slidingly receive a section of the hook of a second laterally adjacent covering panel therein through substantially horizontal displacement of at least one of the first covering panel and the second covering panel.

13. The covering panel of claim 12, wherein one of the at least one flange elevated hammer head stop surfaces and the flange hammer head alignment guide of each flange hammer stop are defined in a front surface of the jaw of a corresponding one of the at least one lateral interconnection tab.

14. The covering panel of claim 1, comprising:

an upper marginal region securable to the bearing substrate; and a covering section extending downwardly from the upper marginal region and having a lower end, the covering section including a plurality of horizontal rows of simulated building elements and being arcuate along a transverse axis of the covering panel, thereby defining a concave curvature, the lower end of the covering section being spaced apart from the bearing substrate when the upper marginal region is juxtaposed and secured to the bearing substrate.

15. The covering panel of claim 14, wherein a deflection of the covering section with regard to the bearing substrate is between 1/16 of an inch and 1 inch.

16. The covering panel of claim 14, wherein each one of the horizontal rows has an upper end and a lower end, each one of the horizontal rows being arcuate and defining a concave curvature, the upper end of each one of the plurality of horizontal rows of simulated building elements being closer to the bearing substrate than the lower end thereof.

17. The covering panel of claim 16, wherein the lower end of each one of the rows of simulated building elements of the covering section is spaced-apart from the bearing substrate when the covering panel is secured to the bearing substrate.

18. The covering panel of claim 16, wherein a deflection of each one of the rows of simulated building elements of the covering section with regard to the bearing substrate is between 1/16 of an inch and 1 inch.

19. The covering panel of claim 14, wherein the covering panel comprises:

a lateral flange comprising at least one lateral interconnection tab having a jaw extending forwardly of a section of the lateral flange and defining a lateral engagement slot; and a lateral section opposed to the lateral flange along the longitudinal axis of the covering panel comprising a hook extending rearwardly from a section thereof;

wherein the lateral interconnection tab and the hook are configured for the lateral engagement slot of the lateral interconnection tab of a first covering panel to slidingly receive a section of the hook of a second laterally adjacent covering panel therein through substantially horizontal displacement of at least one of the first covering panel and the second covering panel.

* * * * *